US005221084A

United States Patent [19]

Stelmach

[11] Patent Number: 5,221,084

[45] Date of Patent: Jun. 22, 1993

[54] BOARD GAME SIMULATING THE PLAY OF FOOTBALL

[76] Inventor: Tom Stelmach, 437 Symington Avenue, Toronto, Ontario, Canada, M6N 2W4

[21] Appl. No.: 874,690

[22] Filed: Apr. 28, 1992

[51] Int. Cl.[5] ..... A63F 9/00

[52] U.S. Cl. ..... 273/94; 273/259; 273/277; 273/247

[58] Field of Search ..... 273/85 R, 85 E, 94, 273/247, 298, 259, 277

[56] References Cited

U.S. PATENT DOCUMENTS 2,517,460 8/1950 Arnn ..... 273/94 R
2,946,134 7/1960 Neilson ..... 273/94 R
3,817,524 6/1974 Board ..... 273/94 R
4,082,278 4/1978 Bolton ..... 273/94 R

*Primary Examiner*—V. Millin
*Assistant Examiner*—William M. Pierce

[57] ABSTRACT

A sport game apparatus comprises a board having a sport surface which is provided with a grid pattern dividing the surface into individual player piece location segments. The apparatus further includes a plurality of player pieces movable on the sport surface, setup cards having a least a portion of the sport surface including the grid pattern reproduced in reduced scale on the cards for accurate initial setup of the player pieces in the segments according to the cards and a movement indicator for determining player piece movement along the board.

13 Claims, 4 Drawing Sheets

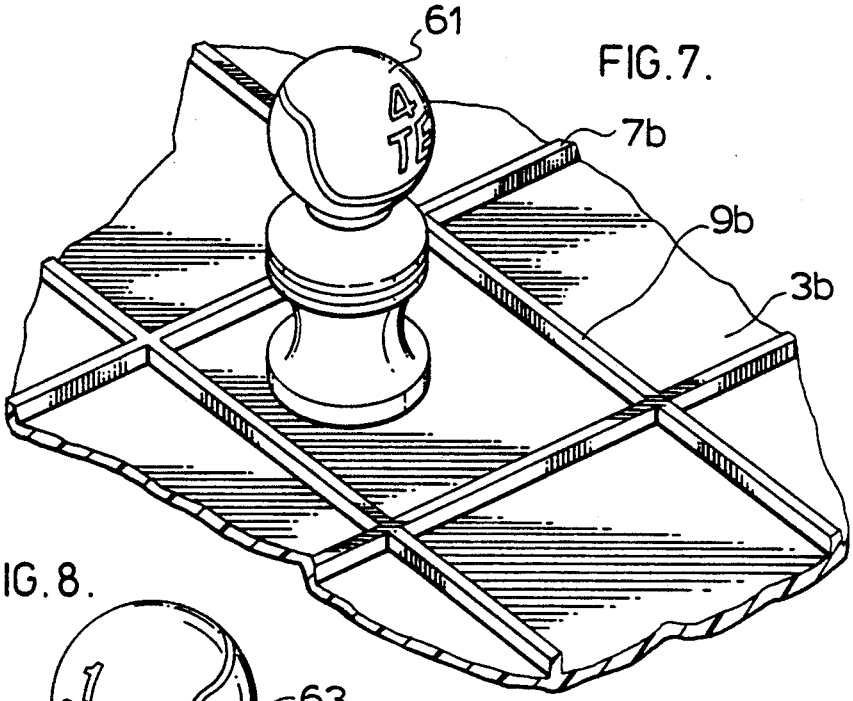
FIG. 7.
FIG. 8.
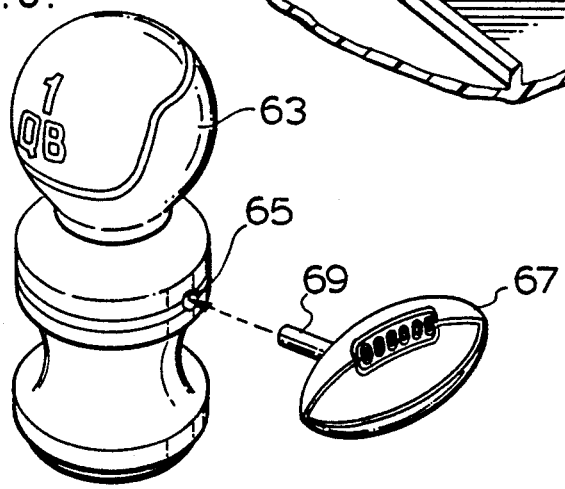
FIG. 9.
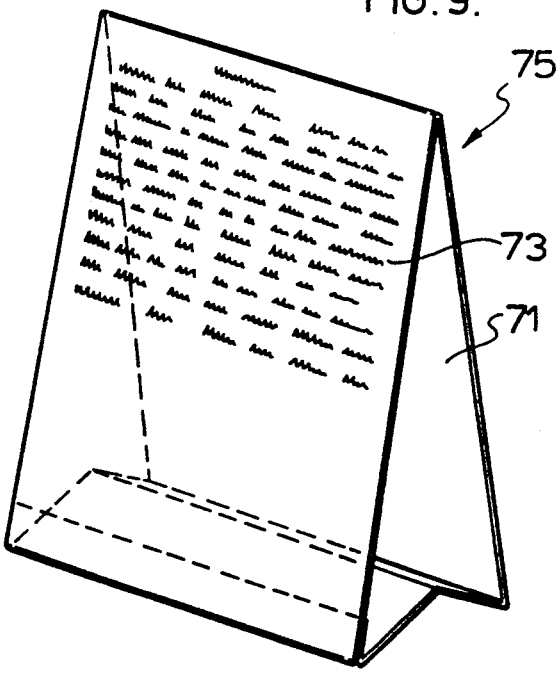

BOARD GAME SIMULATING THE PLAY OF FOOTBALL

FIELD OF THE INVENTION

The present invention relates to a sport game which simulates playing surface conditions and player movement of an actual sport game.

BACKGROUND OF THE INVENTION

Games have always been popular. However, in view of today's up to date technology and marketing strategies, many of yesterday's games are now overly simplistic and therefore do not have consumer appeal.

It is becoming ever more apparent that in order for a game to be successful it must simulate, to a great extent, an actual life situation. For instance, in a sports game players want to play the game under, as much as possible, the same conditions as sports figures participating in actual playing conditions, particularly at a professional level.

The reproduction of a simulated sports surface on a board is shown in the prior art as, for example, U.S. Pat. No. 4,773,650 issued Sep. 27, 1988 to Doughty and U.S. Pat. No. 4,989,879 issued Feb. 5, 1991 to Nigh. Each of these patents shows a football surface reproduced in miniature scale on a game board. Cards and dice are used to move markers for both offensive and defensive player movement lengthwise of the board.

In each of the above patents, there is nothing provided to simulate actual players on the board surface. Furthermore, player movement is extremely limited in that, as noted above, it only occurs lengthwise of the board. The players are not able to dodge or otherwise try to avoid one another lateral and diagonal movement over the board surface.

U.S. Pat. No. 3,222,068 issued Dec. 7, 1965 to Cowels, describes a football game where the board surface, although in no way simulating an actual football field does allow forward, sideways and diagonal movement of the players over the board surface; however, once again the play of the game does not simulate actual football playing conditions as individual figures are moved singularly from one play to the next through the roll of die or draw of a card. In the Cowels game opposing offenses and defenses are not lined up against one another and moved as a group, as is the case in playing an actual football game.

SUMMARY OF THE PRESENT INVENTION

The present invention provides sport game apparatus which enables the players to control a sport game in much the same manner as a coach and the players would in playing a real sports game.

The specific sport game apparatus of the present invention comprises a board having a sport surface simulated on the board and with the sports surface being provided with a grid pattern dividing the surface into individual player piece location segments. The game further includes a plurality of player pieces movable on the sports surface, setup cards having a least a portion of the sports surface including the grid pattern reproduced in reduced scale on the cards for accurate initial setup of the player pieces in the segments according to the cards and means for determining player piece movement through the various segments of the board.

One of the keys to the present invention is the provision of the setup cards, which appear substantially the same as the actual play cards used by professionals and which, through the reproduction of the grid pattern from the board surface on the cards, allows accurate player piece setup and movement of a plurality of player pieces by both the defense and the offense at one time.

BRIEF DESCRIPTION OF THE DRAWINGS

The above as well as other advantages and features of the present invention will be described in greater detail according to the preferred embodiments of the present invention in which

FIG. 7 is a perspective view of a player piece trapped within a board game segment according to a further preferred embodiment of the present invention.

FIG. 8 is a perspective view of a player piece and a football to be attached to that player piece according to a preferred embodiment of the present invention.

FIG. 9 is a perspective view of a stand-up rules card or guide according to a preferred embodiment of the invention.

DETAILED DESCRIPTION ACCORDING TO THE PREFERRED EMBODIMENTS OF THE PRESENT INVENTION

Figure 1:
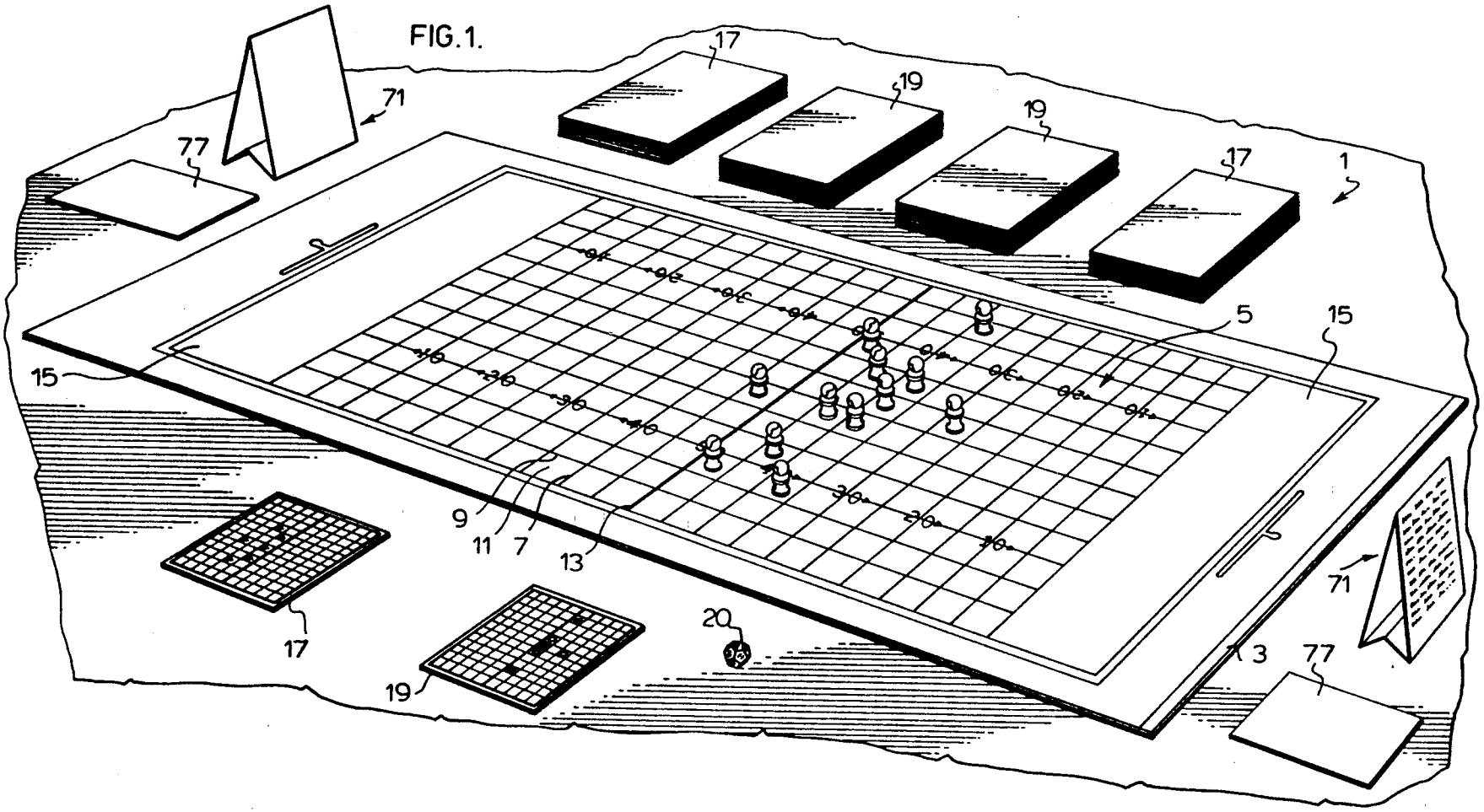
FIG. 1 is a perspective view looking down on sport game apparatus according to a preferred embodiment of the present invention.

FIG. 1 shows a game apparatus generally indicated at 1. This game apparatus comprises a board 3 having a sport surface, generally indicated at 5, reproduced on the board. In this particular case the sports surface is a simulated football field, which as shown, includes yard markers on the opposite side of a centre field dividing line 13 and end zone areas 15 towards opposite ends of the board.

A key element to the board surface is that it includes spaced apart transverse lines 7 as well as spaced apart longitudinally extending lines 9. The intersection of these lines produces a plurality of player piece position segments 11.

Figure 2:
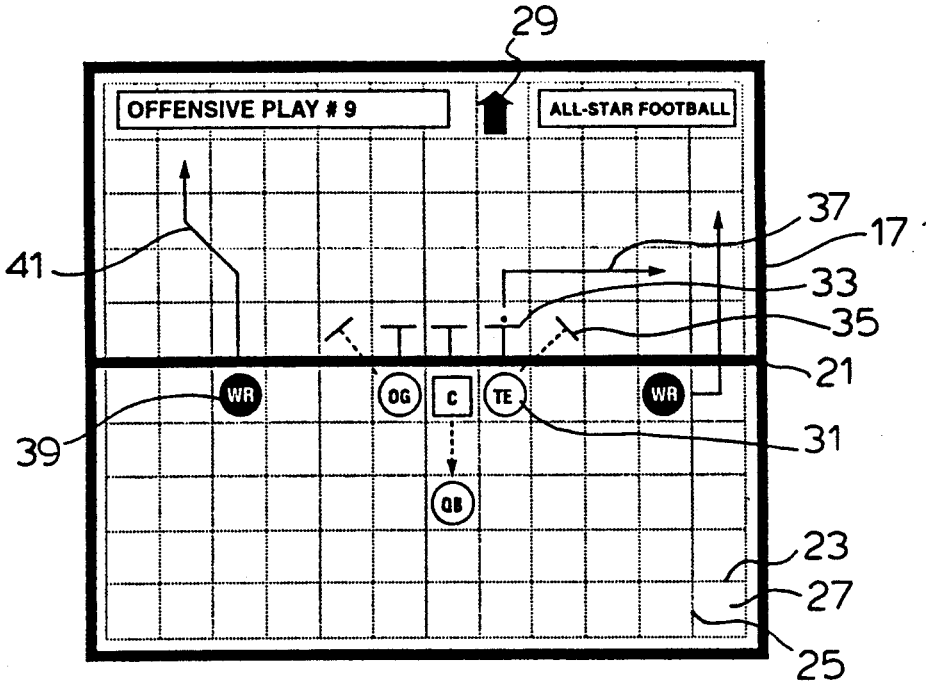
FIGS. 2 and 3 are top plan views of offensive and defensive play cards according to a preferred embodiment of the present invention.
Figure 3:
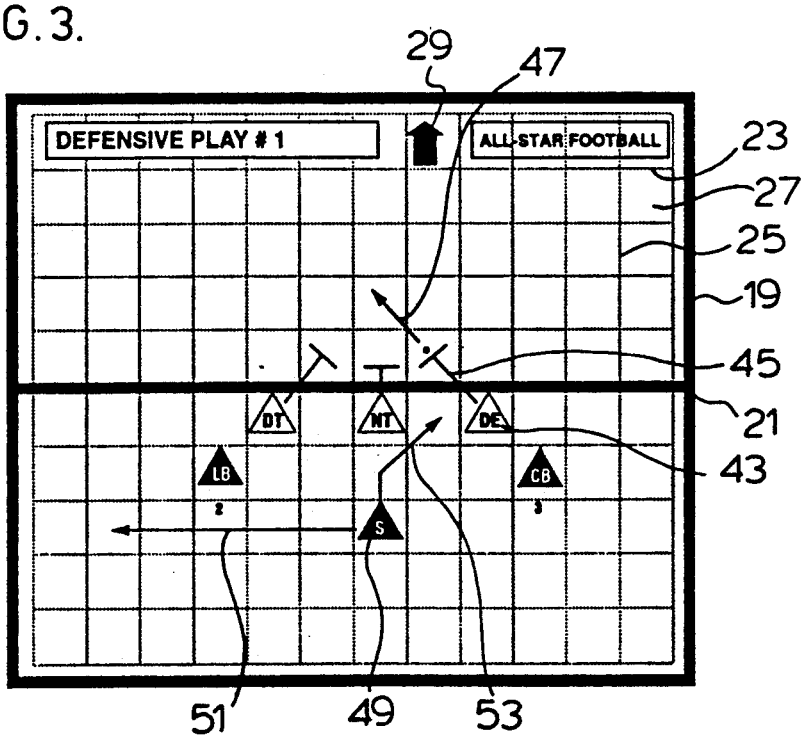

Game apparatus 1 additionally includes at least two sets or teams of player pieces as shown in FIG. 1, as well as player piece setup cards 17 and 19. The teams of player pieces are all of different colours to easily distinguish them from one another. There are two sets of each type of card with cards 17 being offensive play cards and cards 19 being defensive play cards as shown in FIGS. 2 and 3 of the drawings. Each player will therefore have one set of offensive cards and one set of defensive cards.

Also provided is a special die 20 which is used in association with kicking charts to determine length and accuracy of kicks. Conventional die are used in cooperation with cards 17 and 19, to determine player piece movement over the board surface.

The game operates using a series of rules and player logs. Many of the rules are reproduced on self-supporting stand-up cards 71 which, as shown in FIG. 9, have opposing rule printed surfaces 73 and 75. The concept of making the rule cards 71 in a self-supporting stand-up manner is very helpful in that the players are able to use their hands for holding the setup cards 17 and 19 and also for positioning of the player pieces without having to additionally pick up and manipulate a separate rule booklet. The stand-up rule cards 71 allow a quick and easy hands-off reading of the rules.

Additionally provided are two booklets 77, one for each player. These booklets include a more specific detailing of the rules than found on stand-up cards 71 and generally will not have to be referred to as often as the stand-up cards. They also include player logs which indicate the number of segments a particular player piece can be moved for a particular roll of the dice. These logs are mapped out on a relatively enlarged legend and need only be opened to and laid out flat with the legend exposed, once again allowing, to a large extent, a hands-off use of the booklets.

Another key element to the game is the reproduction of a part of the playing surface on a reduced scale on each of the setup cards. These setup cards are much like the cards that a coach or a quarterback might carry for a practice session or even in a real game session. They therefore simulate actual playing conditions.

Each of the offensive and defensive player setup cards includes on a smaller scale the grid pattern on the board's surface as defined on the cards by transversely extending lines 23 and longitudinally extending lines 25, producing player piece location segments 27. Each card further includes highlighted line 21 which simulates the line of scrimmage as an orientation point for the setup of the player pieces identified on each card. The cards additionally include play direction arrows 29, showing the direction in which the player pieces are to be moved in accordance with the card.

Figure 4:
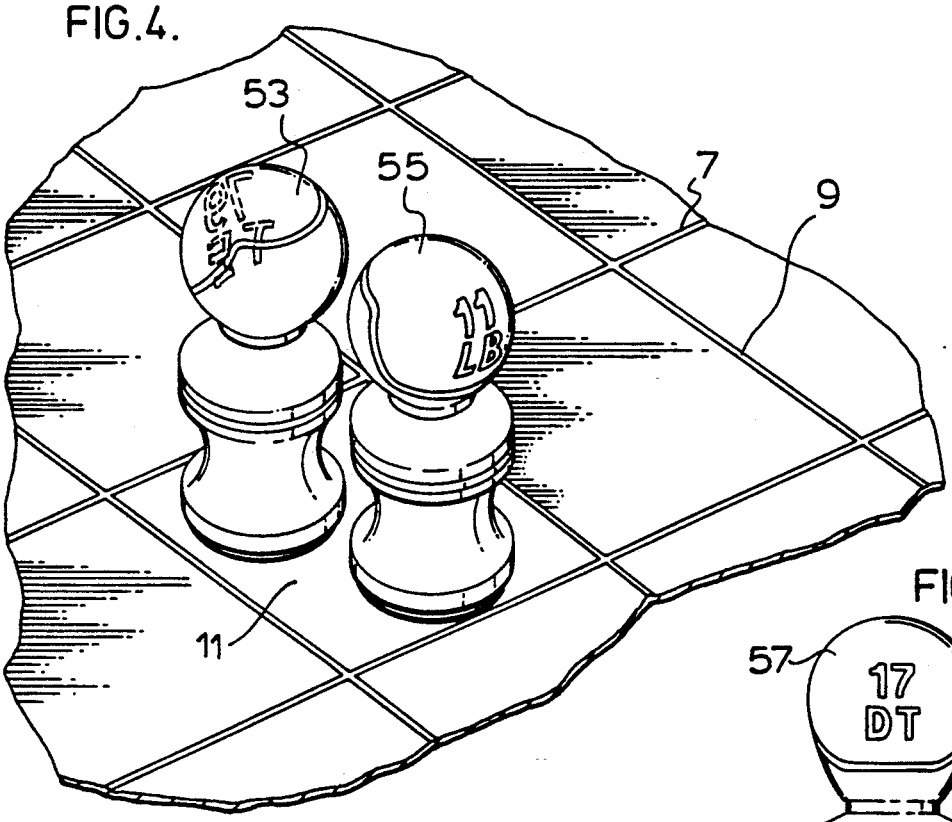
FIG. 4 is an enlarged perspective view of two player pieces occupying a common segment on the board's surface from FIG. 1 of the drawings.
Figure 5:
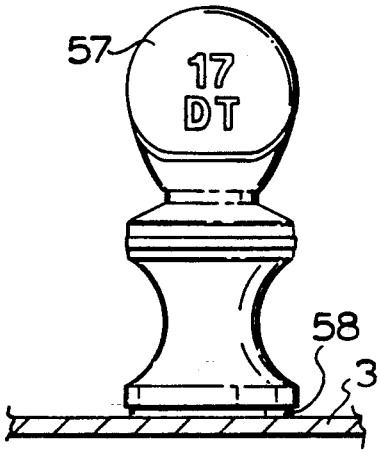
FIG. 5 is a side view of a player piece magnetically secured to the board of FIG. 1.
Figure 6:
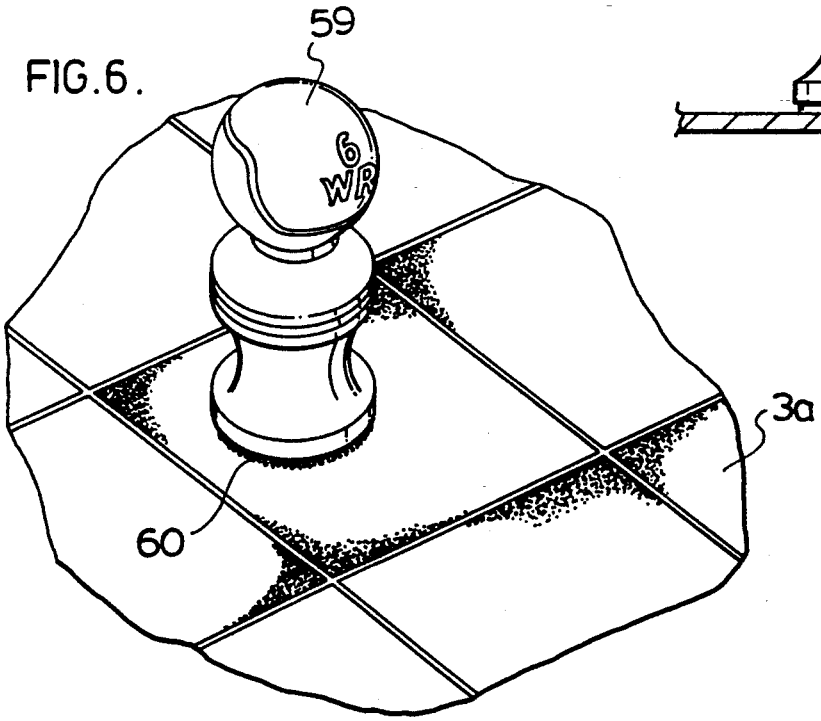
FIG. 6 is a perspective view looking down on a player piece secured to a board surface according to a further preferred embodiment of the present invention.

Different player pieces are shown in FIGS. 4 through 8 of the drawings. Each player (i.e. the person moving the player pieces as opposed to the pieces themselves) starts the game with a full set of offensive and defensive player pieces, although not all of the pieces are placed on the board at any one time. Furthermore, each player piece is identified with a particular player position designation i.e. player pieces 53 and 55 in FIG. 4 are identified with the designations TE and LB or tight end and linebacker respectively. Player piece 57 in FIG. 5 is identified by DT for defensive tackle, player piece 59 of FIG. 6 is identified by WR for wide receiver and player piece 63 is identified by QB for quarterback. These are only specific examples and other player position designations will also be used for the additional player pieces used in the game. The identification of the individual player pieces is important because each person places more than one player piece on the board at one time and it is important to keep track of the actual position or function of each player piece. In the example shown, both the offensive and defensive teams include six player pieces on the field at any one time.

The game includes elements of both luck and skill. The player setup cards are a good example. Each player has a set of offensive play cards and a set of defensive play cards as earlier noted. The persons playing the game make a determination as to who will first be on offense and who will be on defense. A die is rolled by the defensive team to determine the length of the kickoff and the die is rolled by the offensive team to determine the length of the runback. This will place the ball at a specific location on the field at which point the offensive player goes to his offensive play cards and the defensive player goes to his defensive play cards. Each card shows a different player setup and the examples shown in FIGS. 2 and 3 are only representative offensive and defensive player setup cards. Some of the offensive cards will be more geared towards running plays and some will be more geared towards passing plays. Likewise, the defensive play cards give a good selection of a run defense as opposed to a pass defense. The persons playing the game make whatever selection they want from the cards.

The offensive player, after having picked a particular play card, will then set up the specific players shown on that card in the appropriate player locations. Here again the identification of each player piece is important for setup according to the cards. The highlighted line 21 on the card indicates the line of scrimmage and the individual segments on the setup cards show the exact locations for the players to be placed on the board surface. This is true for both the offensive and defensive player pieces. Note that in FIG. 1 where the line of scrimmage is the 40-yard line the players to the left hand side of the line of scrimmage are set up as per the offensive play card of FIG. 2 and the players to the right hand side of the line of scrimmage are set up as per the defensive play card of FIG. 3.

The offensive and defensive play cards not only show initial setup of the player pieces, but in addition, show at least the first move away from the initial setup position. However, not all of the players are moved at one time and as will be seen in FIGS. 2 and 3 some of the players such as the OG for offensive guard, C for centre, TE for tight end and QB for quarterback are marked in white while the two WRs for wide receivers are highlighted in dark on the offensive play card. On the defensive play card the DT for defensive tackle, the NT for nose tackle and the DE for defensive end are highlighted in white while the LB for linebacker, S for safety and CB for corner back are highlighted in dark colours.

On the first play after the kickoff and from the initial setup the offensive player moves his player pieces indicated in white to the appropriate player position. According to the example given, player piece 31 ie. the tight end, can be moved to the position indicated by line 33. This is a blocking position as highlighted by the T-shape of the line. If the block is successful, as to be described later in detail, the tight end can then be moved on the player's next move, along line 37. The arrow indication of line 37 means that the tight end player piece can be moved to any one of the segments through which line 37 passes.

Line 35 from the tight end player piece 31 shows an optional player movement as indicated by the breaks in line 35 which again terminates in a blocking position.

After the offensive player has moved his player pieces indicated in white the defensive player will then move his player pieces indicated in white. For example, player piece 43, the defensive end on the defensive play card, will move along line 45 to a blocking position. If the particular defensive card selected places piece 43 on a segment which is already occupied by a player piece from the offensive card the two player pieces are blocking one another. It is therefore important for blocking purposes as well as tackling purposes that each segment be able to accommodate two player pieces at one time.

If a blocking situation or a tackling situation occurs the players will roll the die and then the person achieving the higher roll effectively breaks away from the block or tackle or completes the tackle as the case may be and is able to continue to move along the board. The person who loses the roll of the die is effectively blocked and that player piece is immobilized until the next roll of the die. If the offensive team wins the roll of the die this then gives the offensive player piece an opportunity to move away from the defensive player piece to an open area for completing a pass, etc. while if the defensive player is successful in completing the block this then freezes the offensive player piece and allows the defensive player piece to, for example, move in towards a quarterback sack or a tackle of a running back.

After the defensive player has moved his player pieces indicated in white on the defensive card the offensive player then moves his player pieces highlighted in dark colouring. For example, player piece 39, the wide receiver, will move along the direction of arrow 41. The wide receiver can be moved to any one of the segments through which arrow 41 passes.

The defensive player then moves his player pieces indicated in dark colour on the defensive play cards. In the example given, only safety player piece indicated by position 49 is moved in the second defensive move and this player piece, the safety, can be moved along either one of arrow 51 or arrow 53. This is dependent on the defensive player's strategy. If for example he wishes to cover the wide receiver in an attempt to block a pass, the safety will be moved to any one of the segments along line 51, depending on the position of the wide receiver. If, on the other hand, the defensive player wishes to block a run or make a charge at the quarterback, he can move the safety to either one of the segments through which line 53 passes.

At this point further player movement in any direction is determined by roll of the conventional die. The player log in booklets 77 indicates how many segments each particular player can move according to the roll of the die. Furthermore the successful completion of a pass from the quarterback is determined according to the roll of the die, results of which are, again, indicated in the player log book. Note that a pass cannot be completed to an eligible receiver who is being effectively blocked by a defensive player. Furthermore, the term eligible receiver covers player pieces who, like professional football, are able to receive passes, as opposed to ineligible receivers, such as lineman. Again, this is an actual simulation of correct football rules, adding to the authenticity of the game and it is important that the player pieces be marked or designated with their particular position in that after a series of moves and with the number of player pieces that are involved at one time, it would be very difficult without the designation to determine where each player piece had started at the setup point. However, by marking the player pieces, the players are always able to determine eligible pass receivers, running backs, quarterbacks, defensive backs and lineman.

As is the case in a real football game, the object of the offensive player is to either score a touchdown or a field goal. The defensive player attempts to stop the offensive player from moving downfield. The roll of the die will indicate how far each player piece is moved on a respective roll and whether or not the defensive player pieces can catch up to the offensive player pieces i.e. by occupying the same segment or square to block offensive player piece movement or to attempt to tackle an offensive player piece carrying the ball, a further roll of the die determine whether or not the tackle has been successful and also determines whether or not there is a fumble. A still further roll of the die indicates which team recovers the fumble.

Another feature that is important is that once the player pieces have been moved, rather than slipping or sliding over the board surface, they stay at the location or in the segment to which they have been moved. This is done by providing an attraction or a sticking of the player pieces to the board. This can be done in any one of a number of different manners. In the embodiment shown in FIG. 1, board 3 is magnetic and, as shown in FIG. 5, player piece 57 has a magnetically attracted base 58. In FIG. 6 board **3*a* has a textured surface and player piece 59 has a lower textured base 60** which grips to the board surface. This can be done using different types of interlocking textures such as, for example, VELCRO TM.

In the FIG. 7 embodiment board **3*b* is provided with raised intersecting borders 7*b* and 9*b* forming the grid pattern on the board surface. In this particular case, player piece 61** is effectively trapped against sliding along the board surface by the raised grid pattern.

In all of the embodiments above it is important, regardless of how the attraction between the player piece and the board is achieved, that each segment is sufficiently large enough to simultaneously receive two player pieces for both blocking and tackling purposes as earlier described.

FIG. 8 shows player piece 63 as including a side recess 65 for receiving peg 69 of a simulated football 67. The football is moved between player pieces according to how the play has developed and clearly indicates which player piece is in possession of the football at any point in time.

Although various preferred embodiments of the invention have been described in detail, it will appreciated by those skilled in the art that variations may be made without departing from the spirit of the invention or the scope of the appended claims. For example, in the specific embodiments shown a football game is simulated, however other games such as hockey, soccer, etc. could also be played using the same board game principles altered according to the particular sport involved.

I claim:

1. Sport game apparatus comprising a board having a sport surface simulated on said board, said sport surface being provided with a first grid pattern dividing said surface into individual player piece location segments, a plurality of player pieces moveable on said sport surface, means for determining player piece movement and setup cards having a second grid pattern smaller than said first grid pattern and having representations of the player pieces within said second grid pattern for accurate initial set up of the player pieces in said segments on said board according to said cards.

2. Apparatus as claimed in claim 1 wherein each player piece has a supporting base and each segment on the board surface is sized to receive the bases of side by side player pieces which when located in a single segment are in a blocking position relative to one another.

3. Apparatus as claimed in claim 1 includes means for securing the player pieces to all areas on the board.

4. Apparatus as claimed in claim 3 wherein said sport surface comprises a magnetic layer and wherein said player piece comprises magnetically attracted material.

5. Apparatus as claimed in claim 3 wherein said sport surface and said player pieces include releasably interlocking textures.

6. Apparatus as claimed in claim 1 wherein said grid pattern is raised on said sport surface such that each player piece location segment is defined by a raised border for trapping of the player pieces in the segments.

7. Apparatus as claimed in claim 1 including two sets of offensive play cards and defensive play cards.

8. Apparatus as claimed in claim 1 wherein said player pieces include two sets of offensive player pieces and defensive player pieces.

9. Apparatus as claimed in claim 8 wherein each player piece is marked with a player position designation.

10. Apparatus as claimed in claim 1 including offensive and defensive player pieces and said setup cards comprising offensive play cards and defensive play cards.

11. Apparatus as claimed in claim 10 wherein each player piece is marked with a player position designation and wherein each setup card includes player setup locations marked with corresponding player position designations.

12. Apparatus as claimed in claim 1 including a rules card, said rules card having a standup construction for hands-off reading of said rules card.

13. Apparatus as claimed in claim 1 including different teams of player pieces, each team being of a different colour than all other teams.

* * * * *